United States Patent [19]

Brennan

[11] 3,937,471

[45] Feb. 10, 1976

[54] MULTIPLE-BOARD CHESS GAME WITH ADDITIONAL CHESSMEN

[76] Inventor: Gerald R. Brennan, 1012-112th SE., Seattle, Wash. 98004

[22] Filed: Aug. 5, 1974

[21] Appl. No.: 494,730

[52] U.S. Cl. ..... 273/131 AC
[51] Int. Cl.[2] ..... A63F 3/02
[58] Field of Search ..... 273/131

[56] References Cited

UNITED STATES PATENTS

| | | | |
|---|---|---|---|
| 1,877,154 | 9/1932 | Weaver | 273/131 AC |
| 3,767,201 | 10/1973 | Harper et al. | 273/131 AC |

FOREIGN PATENTS OR APPLICATIONS

| | | | |
|---|---|---|---|
| 601,062 | 4/1948 | United Kingdom | 273/131 AC |

OTHER PUBLICATIONS

Time Magazine, Feb. 4, 1952, p. 15 cited.
Space Chess by Earl W. Major; received 7–26–73.

*Primary Examiner*—Delbert B. Lowe
*Attorney, Agent, or Firm*—Cole & Jensen

[57] ABSTRACT

Two substantially identical standard chessboards are provided in parallel alignment such that the squares on one board are vertically aligned with the squares on the other board. The two boards, conveniently termed upper and lower boards, are sufficiently spaced to permit the placement of chessmen on the lower board. Two sets of conventional chessmen are also provided, along with two sets of additional chessmen, the conventional chessmen and the additional chessmen, under the preferred rules of the game, being initially positioned on opposing boards, and then, in the progress of the game, moving between and on both boards in a predetermined manner to capture chessmen of the opposing player. The upper board is transparent, permitting easy visual inspection of the location of the chessmen on the lower board so that the game may be conveniently played.

11 Claims, 11 Drawing Figures

MULTIPLE-BOARD CHESS GAME WITH ADDITIONAL CHESSMEN

BACKGROUND OF THE INVENTION

This invention relates generally to the game art, and more specifically concerns a new chess game.

The conventional game of chess is played on a two-dimensional game board of alternating dark and light squares, with two players. After mastering the basic game, however, a player often desires variations which are more complicated or include more than two players. The present invention is directed toward a chess game which accommodates the conventional two players, but which includes a second conventional chess board constructed to be used in conjunction with the original board and additional chessmen to provide a new chess game of increased complexity.

Accordingly, a general object of the present invention is to provide a new chess game.

Another object of the present invention is to provide such a chess game which includes a conventional chess board and conventional chessmen.

It is a further object of the present invention to provide such a chess game which may be quickly mastered by one who knows the basic rules of conventional chess.

It is yet another object of the present invention to provide such a chess game which uses at least two chess boards and wherein the chessmen move between the boards.

It is a still further object of the present invention to provide such a chess game which includes additional chessmen for each player.

SUMMARY OF THE INVENTION

According to the invention, a multi-level chess game is provided which includes two chess boards, the chess boards being spaced vertically away from each other. Two conventional sets of standard chessmen are provided, with each conventional set including a king, a queen, two knights, two bishops, two rooks, and eight pawns, the two conventional sets of standard chessmen furthermore being initially positioned in standard fashion on one of the two chess boards. Two additional sets of standard chessmen are also provided, with each of the additional sets consisting of: (1) at least one additional royalty piece, chosen from the group consisting of: queen, bishop, rook, and knight; and, (2) a minimum of one additional pawn and at least the same number of additional pawns as there are queen and rook royalty pieces in each of said additional sets, each of said additional sets being initially positioned on the other chess board.

More specifically, and preferably, the two chess boards are substantially identical, with one chess board being substantially transparent. Furthermore, each additional set of standard chessmen provided will preferably include only two royalty pieces, the royalty pieces being selected from the group consisting of queen, rook, bishop and knight, and with the additional set of standard chessmen further including only two pawns.

DESCRIPTION OF THE DRAWINGS

A more thorough understanding of the invention may be obtained by a study of the following detailed description taken in connection with the accompanying drawings in which.

DESCRIPTION OF THE PREFERRED EMBODIMENT

Figure 1:
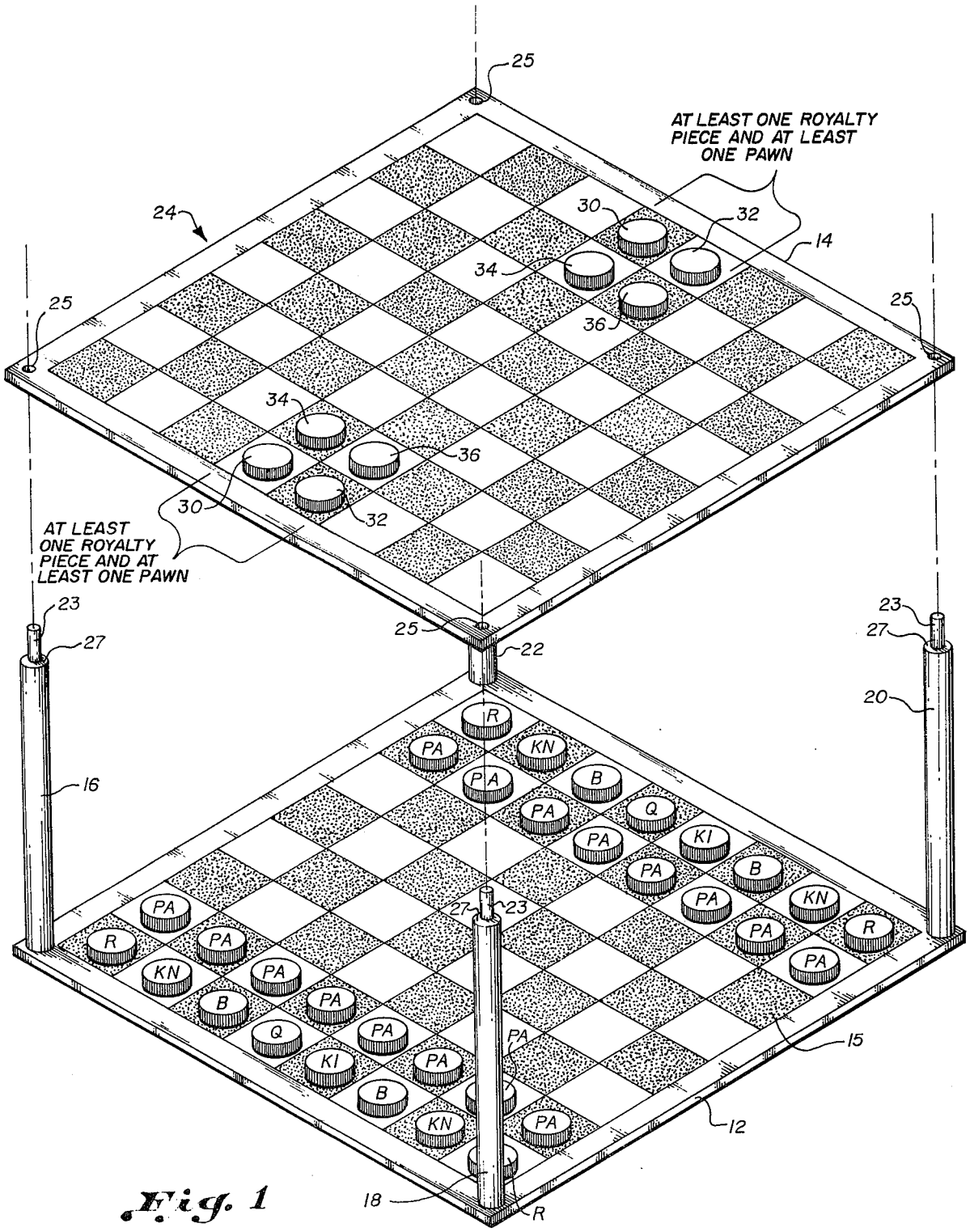
FIG. 1 is an exploded view showing the double-decked two-board arrangement of the preferred embodiment.

Referring to FIG. 1, lower game board 12 and upper game board 14 are shown in an exploded view for purposes of clarity of explanation. In use, they are spaced apart from one another a sufficient distance to permit the placement of chessmen on lower game board 12. Each board is substantially square and has displayed thereon a total of 64 identically-sized squares 15 arranged into eight rows and eight columns, referred to as ranks and files, of alternating colors of white and black or any other two contrasting colors. This is, of course, identical to the arrangement of a conventional chessboard. The boards 12 and 14 are spaced apart a predetermined distance by identical spacers 16, 18, 20 and 22, the boards being removably secured at each corner thereof to the opposite ends of the spacers. The two boards are thus rigidly spaced apart from one another and provide sufficient support for placement and movement of the chessmen thereon. The spacers 16, 18, 20 and 22 are typically solid elongated cylinders, having projecting end portions 23 of smaller diameter than the remainder of the cylinder, which engage identical openings 25 located in the corners of the boards. Each spacer includes a shoulder portion 27 where the end portion meets the remainder of the spacer so that the boards 12 and 14 may be securely positioned at predetermined points along the length of the spacers.

Since the spacers 16, 18, 20 and 22 are substantially equal in length, the two game boards 12 and 14, when secured therewith, will be in parallel planes spaced apart a predetermined distance from each other. Boards 12 and 14 are furthermore so arranged that the respective playing squares of the playing surface of the lower board 12 are vertically aligned with the playing squares of the upper board 14, the squares on the lower board thus opposing the squares on the upper board. Furthermore, the boards are identically oriented, such that, when lower board 12 is horizontal, the playing surfaces of boards 12 and 14 are aligned if viewed directly from above the upper board 14.

In play, the board structure 24, comprising boards 12 and 14, and spacers 16, 18, 20 and 22, is oriented horizontally. The upper board 14 is transparent, with a slight shading provided in those squares which are designated dark, the transparency of the upper board 14 facilitating the viewing of the chessmen present on the lower board 12 during the progress of the game, as well as the playing of the game and movement of the chessmen between boards.

Provided with the board structure 24 are a plurality of chessmen, a substantial number of which are identical to standard chessmen. Each player has the following conventional chessmen: a king, a queen, two bishops, two knights, two rooks, and eight pawns. In addition to these standard chessmen, however, each player has four additional pieces, 30, 32, 34, and 36. Preferably, the conventional chessmen are initially positioned in the standard manner on the lower board 12, while the four additional chessmen are initially positioned on the upper board 14 in the squares ordinarily occupied by the king, queen, the king's pawn and the queen's pawn. The additional chessmen provided for each player form an important part of the preferred embodiment of the present invention. With the addition of the second board and the provision that the individual chessmen may move between boards, the respective kings are significantly more vulnerable to attack. The additional chessmen are provided to strengthen the defensive capability of each player and for strong initial protection of the king. This results typically in longer and more unpredictable games.

In the preferred embodiment, the additional chess pieces move in a manner similar to but not identical with selected conventional pieces. It is within the scope of the invention, however, that at least the additional chessman initially positioned in the king's position, and preferably the chessman positioned in the queen's position as well, be selected from the group of chessmen comprising the queen, the bishop, the rook, and the knight, commonly referred to as "royalty" chessmen. The addition of the royalty piece initially placed in the king's position provides the strong defensive capability desirable to balance the increased offensive capability inherent in the game. The royalty piece initially positioned in the queen's position provides protection for the player's queen and increases the king's protection, thereby forming a strong initial defense against capture of one's king from the other board. Since the two additional royalty pieces are capable of wide-ranging individual moves, two protective pieces similar to pawns in movement are provided initially in the queen's pawn and king's pawn positions, respectively.

Thus, as the game commences, each player has a standard set of chessmen arranged in the standard manner on the lower board 12 and the four additional chessmen 30, 32, 34, and 36 arranged as shown on the upper board 14, although the chessmen on the two boards could be interchanged if desired.

Under the preferred rules of the game, each of the standard chessmen moves and captures with respect to the board on which it is initially positioned (e.g., board 12) in standard fashion. Thus, a pawn may move two spaces forward on its first move and one space forward thereafter or capture on the forward diagonals; a rook may move any number of open spaces along the rank or file passing through the square on which it is positioned; a bishop may move any number of open spaces along the diagonals passing through the square on which it is positioned; a knight's move includes two spaces along either a rank or file passing through the square on which it is initially positioned, and then one additional space at right angles thereto; a queen may move any number of open spaces either in a rank or file or along a diagonal passing through the square on which it is initially positioned; and the king may move one space in directions similar to that of the queen.

The conventional chessmen may also, however, move between boards 12 and 14, referred to as the transcendent move. In showing the transcendent moves of the various chessmen in the drawings, the chessmen are shown moving from a position on one board shown by solid lines in the direction of the arrows to its correct position on the other board, shown by dashed lines. Furthermore, the board on which the chess piece is located when the transcendent move is initiated is referred to as the "original" board, and the other board is the "opposite" board.

Figure 2A:
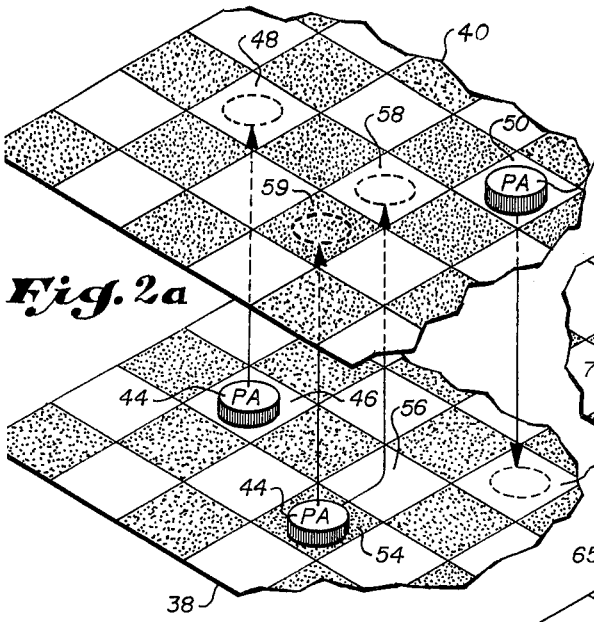
FIG. 2*a* is an isometric view showing a portion of the two boards of FIG. 1, and in particular, the transcendent moves of the pawn.

The pawn may transcend between boards only to capture an opponent's piece, with the exception of its first move. In its transcendent move, referring to FIG. 2*a*, the pawn moves directly vertically between boards 38 and 40 to capture a piece occupying the corresponding opposing space on the opposite board. Thus, the pawn 44 may transcend, for instance, from square 46 on board 38 to square 48 on board 40, or, for instance, from square 50 on board 40 to square 52 on board 38. On its initial move, the pawn has the opportunity of either directly transcending between boards to capture or occupy (e.g., from square 54 of board 38 to square 59 on board 40), or it may advance one square on the board on which it is positioned (e.g., from square 54 to square 56) and then transcend to the opposing square 58 on the opposite board without capturing. Under the preferred rules of the game, the pawn may move "through" a piece on square 56 enroute to square 58.

Figure 2B:
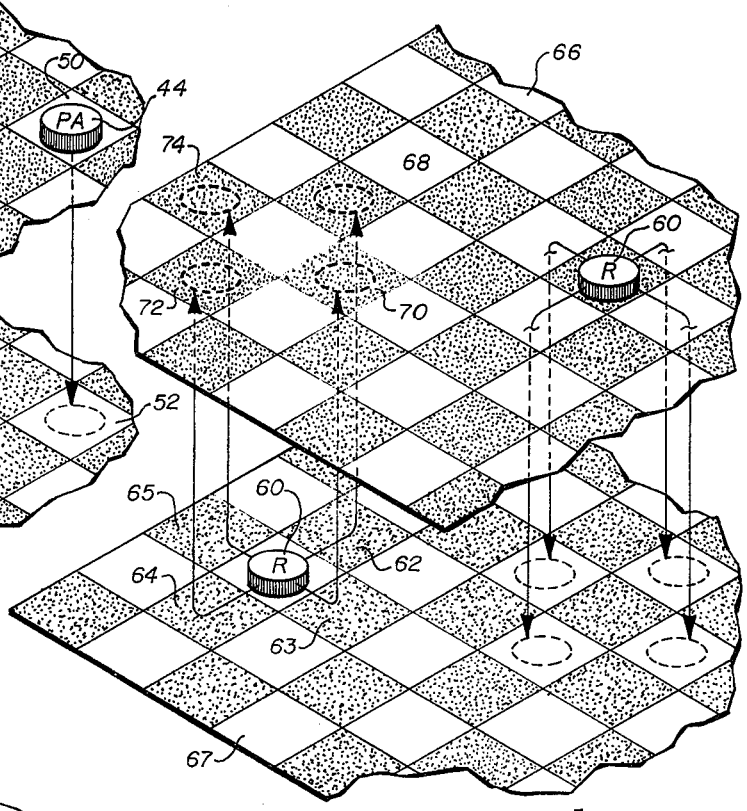
FIGS. 2*b* through 2*f* are views similar to that of FIG. 2*a* showing the transcendent moves of the rook, bishop, knight, queen and king, respectively.

In its transcending move, referring to FIG. 2*b*, the rook 60 moves one square (to one of the squares 62, 63, 64 or 65) on its rank or file on the original board, shown as board 67 in FIG. 2*b*) and then moves vertically to the opposing square (68, 70, 72 or 74) on the opposite board, where it captures an opponent's chessman located in that square. Under the preferred rules, the rook may move through other chessmen on the original board during its transcending move.

Figure 2C:
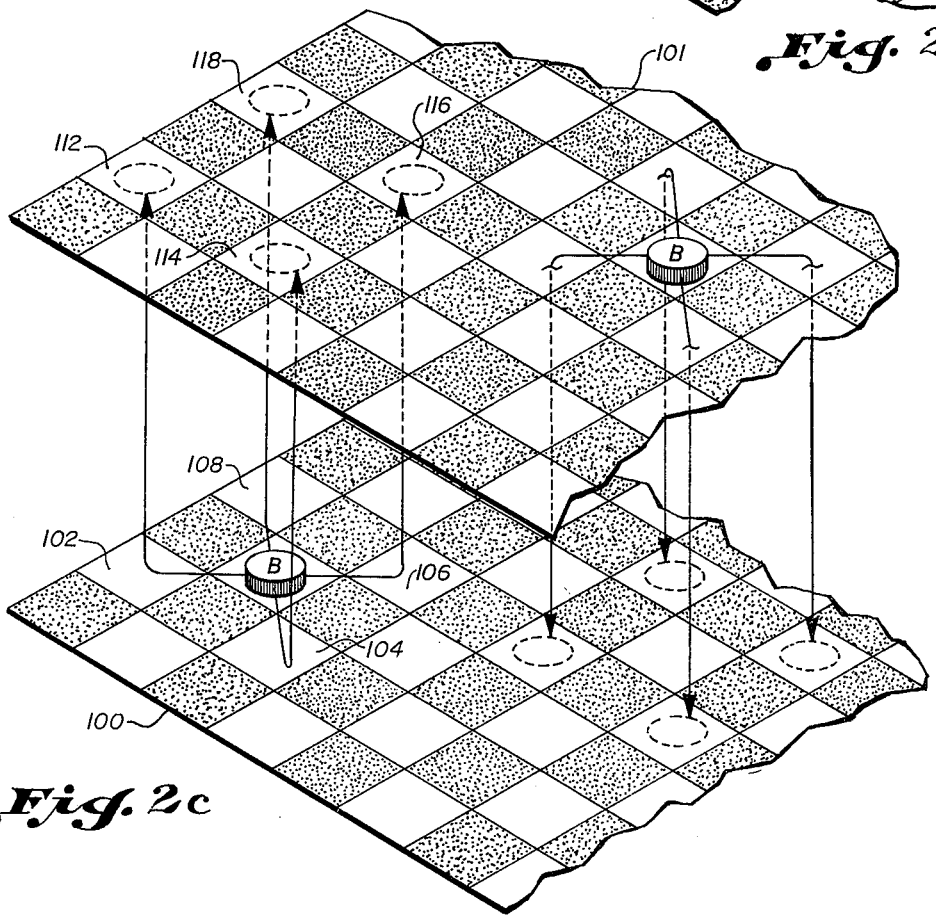

The bishop's transcending move, referring now to FIG. 2*c*, permits movement thereof for one square (to one of the squares 102, 104, 106 or 108 on board 100) along its diagonals and then directly vertically to the opposing square 112, 114, 116 or 118 on the opposite board 101 for either capture of an opponent piece or occupation. In a similar fashion, the bishop may move from board 101 to board 100. The bishop may move through chessmen from either side present on the original board during its transcending move.

Figure 2D:
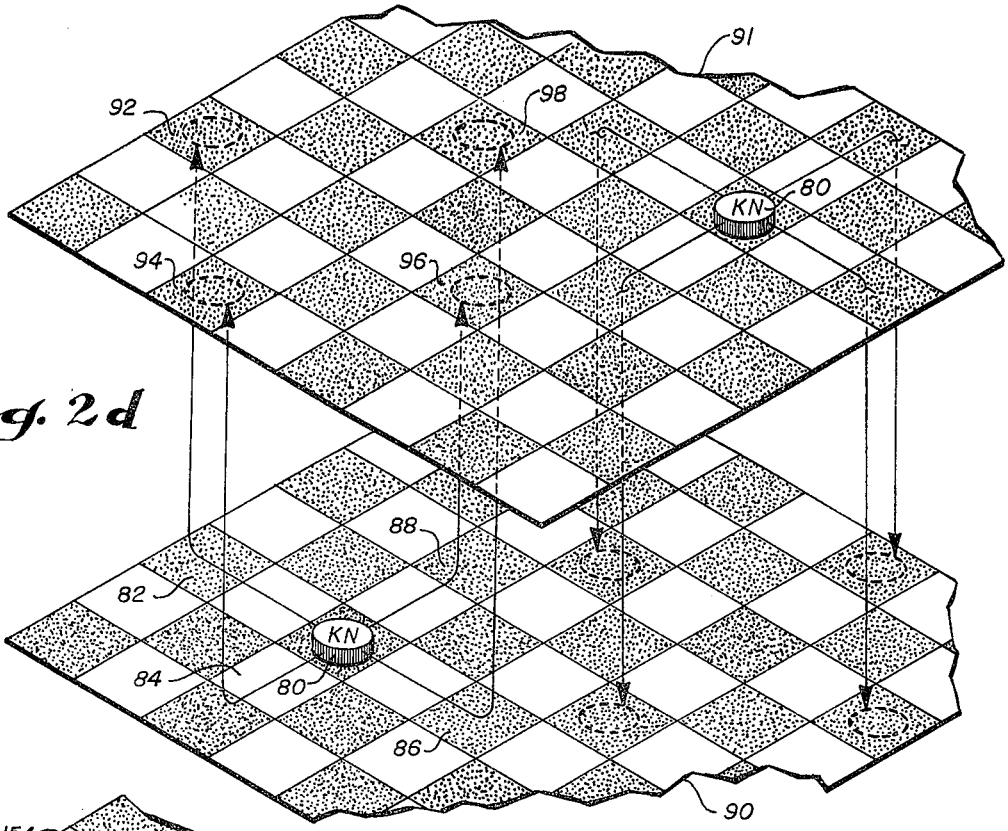

In its transcending move, referring to FIG. 2*d*, the knight 80 moves two squares (to one of the squares 82, 84, 86 or 88) on its rank or file on board 90, and then moves directly vertically to the opposing square 92, 94, 96 or 98 on the opposite board 91. In a similar manner the knight may move from board 91 to board 90. The knight may capture an opponent's chessman which is located in the opposing square and has the capability of making the transcending move through pieces from both sides on the original board.

Figure 2E:
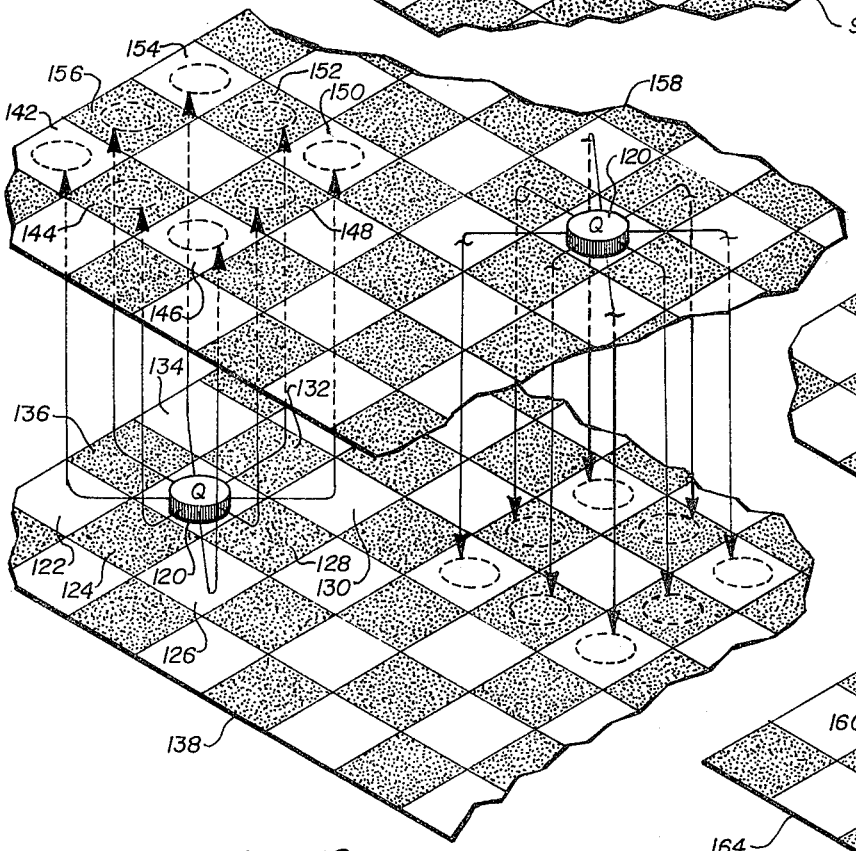

In its transcending move, referring to FIG. 2*e*, the queen 120 may move one square (to one of the squares 122, 124, 126, 128, 130, 132, 134, or 136) on board 138 in its rank, file or along its diagonals, and then directly vertically to the opposing square 142, 144, 146, 148, 150, 152, 154, or 156, on the opposite board. In similar fashion, the queen 120 may transcend from board 158 to board 138. The queen may capture the piece in the square to which it moves or may occupy it, and moves through chessmen from both sides on the original board.

Figure 2F:
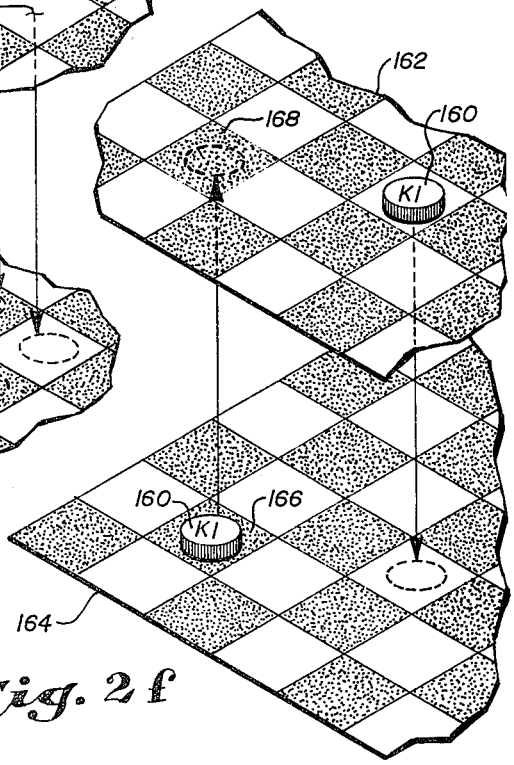

The transcending move of the king 160, referring now to FIG. 2*f*, permits movement thereof directly vertically between boards 162 and 164. For instance, the king may move from square 166 on board 164 to the opposing square 168 on the opposite board 162. The transcending move of the king permits capture of an opposing piece on, or occupation of, squares on the opposite board.

As noted above, four new chessmen are preferably provided for each player, referred to in this application, for purposes of explanation, as shade, jerraden, karma and prana. For clarity of explanation, the initial position of the new chessmen is on the upper board. The pieces may, of course, be known by other names. Under the preferred rules of the new game, each of the four new chessmen moves in a particular manner (more fully explained in the following paragraphs) which is different from but which resembles the moves of certain standard chessmen. However, it is not necessary in order to practice the invention that the four additional chessmen move precisely as specified in the preferred embodiment. As an example, two of the pieces, karma and prana, which are initially positioned in the queen's and king's squares on the upper board, could be conventional royalty pieces chosen from the group comprising the queen, the rook, the bishop, and the knight. Any one of those chessmen initially positioned in the karma and prana positions will provide the offensive and defensive capability necessary to accomplish the purposes of the present invention.

Additionally, jerraden and shade, which initially occupy the queen's pawn and king's pawn positions on the upper board have moves which in total are novel. However, for the purposes of the present invention, jerraden and shade could be conventional pawns, or have other moves similar thereto, as long as the moves which shade and jerraden have provide an initial defense for the prana and karma pieces.

Figure 3A:
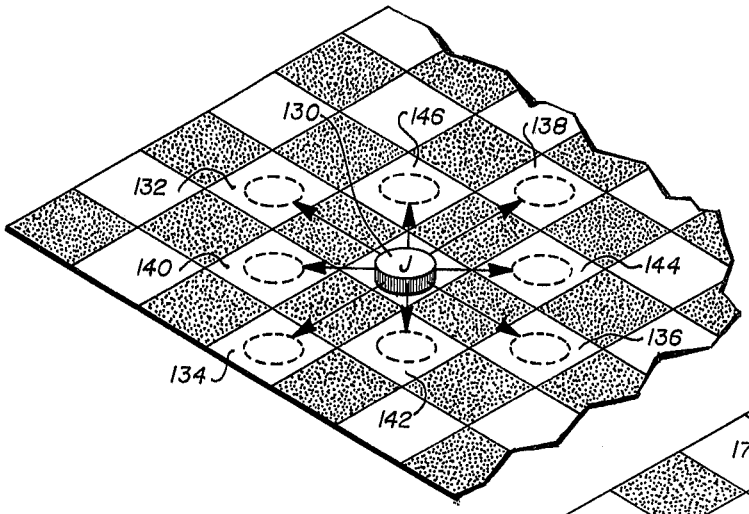
FIG. 3*a* is an isometric view of a portion of a chess board and showing the moves on each board of the additional chessman jerraden.

Jerraden initially occupies the king's pawn position of each player on the upper board 14. Although jerraden could be a standard pawn it is provided with unique moves in the preferred embodiment so as to provide maximum protection for the chessmen in the king and queen position. Referring to FIG 3*a*, jerraden 130 moves two squares (to one of the squares 132, 134, 136 or 138) in its rank or file or may move one square (to one of the squares 140, 142, 144, or 146) on any of its diagonals. The movements of jerraden on both boards are the same, although jerraden can only capture an opposing chessman on the board on which jerraden is initially positioned (upper board), or during its transcending move. Furthermore, jerraden can be captured only when it is on the upper board or by a transcending move from an opponent when it is on the lower board. The transcending move of jerraden is similar to that of the rook, shown in FIG. 2*b*. Under the preferred rules, jerraden is permitted to move through other chessmen on both boards, although other chessmen may move through jerraden during a transcending move or when jerraden is on the lower board.

Figure 3B:
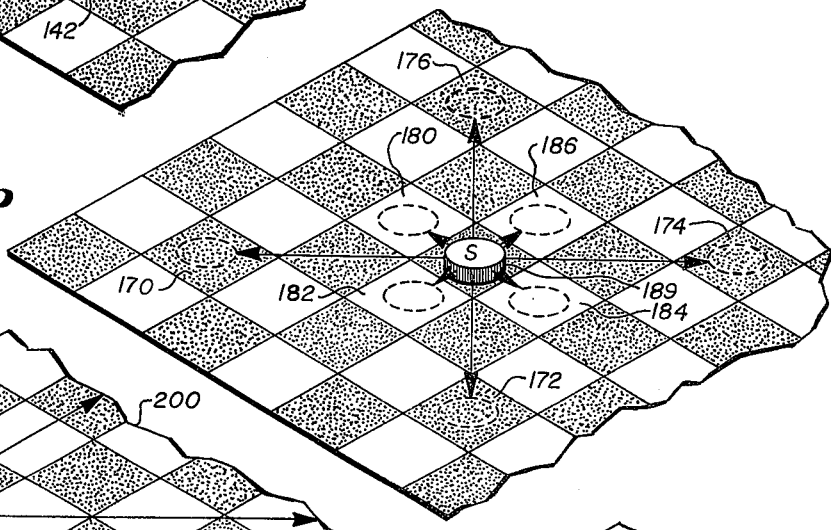
FIGS. 3*b* through 3*d* are views similar to that of FIG. 3*a* showing the moves on the respective boards of the additional chessmen shade, karma and prana, respectively.

Shade initially occupies the queen's pawn position on the upper board. Referring to FIG. 3*b*, shade 189 can move two squares (to one of the squares 170, 172, 174 or 176) in its diagonals or one square (to one of the squares 180, 182, 184 or 186) in its rank or file on either the upper or lower board. Shade captures only on the upper board (the initial position board) or as a result of a transcending move. Shade may not be captured on the lower board except as a result of a transcending move from a chessman of the opposing player. The transcending move of shade 189 is similar to that of the transcending move of the conventional bishop, described above with respect to FIG. 2*c*. As with jerraden, shade is permitted to move through other chessmen on both boards under the preferred rules, and other chessmen may move through shade during a transcending move or when shade is on the lower board.

Figure 3C:
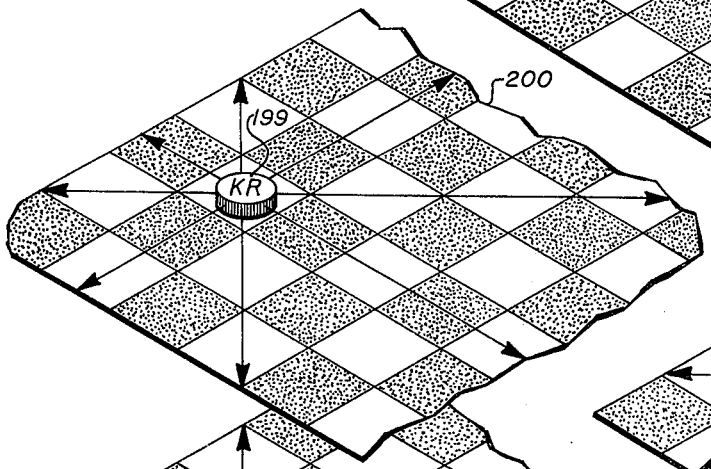
Figure 3C:
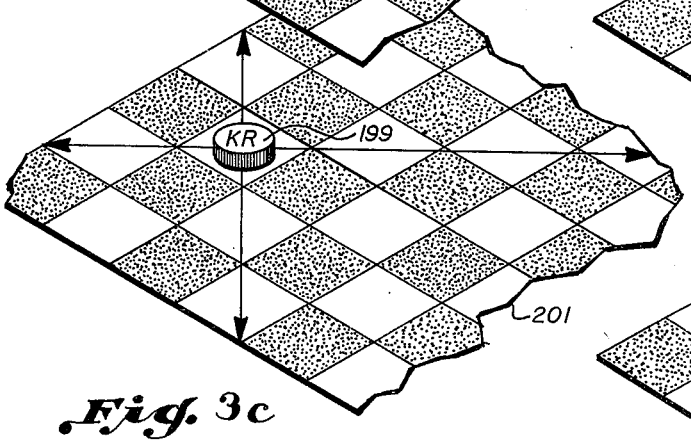

Karma initially occupies the queen's position on the upper board. Referring to FIG. 3*c*, karma 199 moves and captures on the upper board 200 as a conventional queen while on the lower board 201 moves and captures as a conventional bishop. Karma's transcending move is identical to the transcending move of the conventional queen, shown in FIG. 2*e* and described above, as it moves one space on its diagonals or on its rank or file on the original board, and then directly vertically to the opposing square on the opposite board, where it may capture or occupy.

Figure 3D:
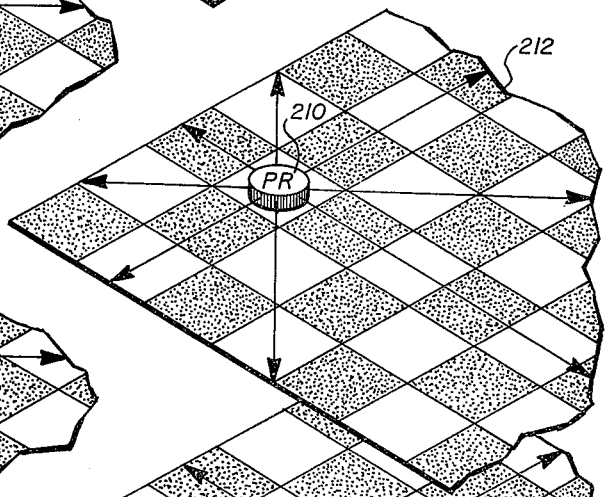
Figure 3D:
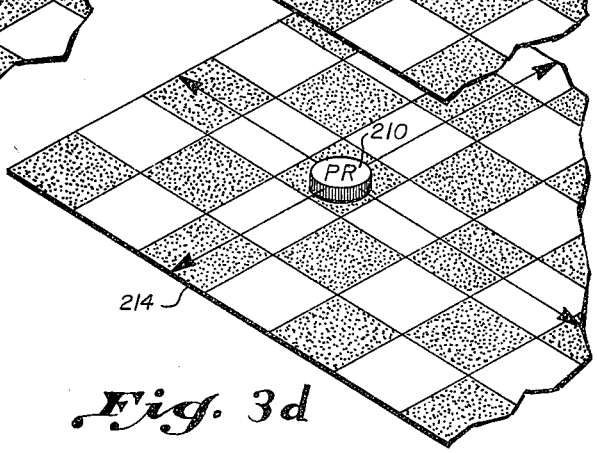

Prana initially occupies the king's position on the upper board. Referring to FIG. 3*d*, prana 210 moves and captures as a queen on the upper board 212 while on the lower board 214 it moves and captures as a rook. The transcending move of prana is also identical to the transcending move of the conventional queen, shown in FIG. 2*e*, in that it may move one square along its diagonals or in its rank or file on the original board, and then directly vertically to an opposing square on the opposite board, where it may capture or occupy.

In play, the players conventionally take turns, with the primary goal of the game being to capture the opposition's king.

By providing a double-decked board arrangement wherein at least two conventional chessboards are provided in stacked fashion (one above the other), and with the conventional chessmen being permitted to move via transcending moves between boards, a significant amount of variation is introduced into the conventional chess game. The addition of the extra board provides a significant increase in possible variations of offensive tactics. The additional pieces, however, notably the royalty pieces initially positioned in the king's and queen's position on the upper board, provide the required defensive capability to balance the increased offensive capability provided by the two boards. The combination results in a more complex chess game, and frequently a lengthier, more varied, chess game with many more strategic permutations possible than in standard chess, although still permitting the sudden victories which characterize standard chess.

A primary beneficial result achieved by the new chess game is that it permits the average amateur chess player to introduce, in a relatively easy manner, a significant amount of offensive and defensive variations into his particular manner of play without the necessity of years of study and play, such as would typically be required to correspondingly increase one's capability in conventional chess. Thus, the present chess game allows the chess player who enjoys chess as an avocation to significantly increase the variations in and complexity of the chess game he plays, without requiring a corresponding amount of sophistication in his playing ability.

It should be understood that many of the preferred moves of the additional individual chessmen may be altered in some fashion, without departing from the spirit of the invention. For instance, the additional chessmen initially provided in the king's and queen's positions on the upper board may be any one of the royalty pieces, or may have a unique combination of moves as described in the preferred embodiment. It is desirable, however, that these two additional pieces have a significant amount of defensive capability, and, also, that additional pieces be provided to initially protect them from capture on the first move of the opposing side. Additional chessmen could also be provided on the upper board, making the game more complex. It should also be understood that other changes and modifications of the expanded chess game described above may be incorporated in the preferred embodiment without departing from the spirit of the invention—which is defined by the claims which follow.

What is claimed is:

1. A multi-level chess game for three-dimensional play, comprising:

first and second but no more than two chess boards;

means for spacing said chess boards vertically away from each other;

two conventional sets of standard chessmen, each of said conventional sets including a king, a queen, two knights, two bishops, two rooks, and eight pawns, each of said conventional sets being initially positioned in standard fashion on said first chess board; and two additional sets of standard chessmen, each of said additional sets consisting of:

1. at least one additional royalty piece, chosen from the group consisting of: queen, bishop, rook and knight; and

2. a minimum of one additional pawn and at least as many additional pawns as there are queen and rook royalty pieces in each of said additional sets, each of said additional sets being initially positioned on said second chess board.

2. The game of claim 1, wherein at least one of said chess boards is substantially transparent.

3. The game of claim 1, wherein said chess boards are substantially identical.

4. The game of claim 1, wherein each of said additional sets of standard chessmen includes at least two royalty pieces and at least two pawns.

5. The game of claim 4, wherein at least one of said royalty pieces is a queen.

6. The game of claim 5, wherein each of said additional sets includes at least as many pawns as royalty pieces.

7. The game of claim 6, wherein each of said additional sets includes exactly as many pawns as royalty pieces.

8. The game of claim 1, wherein the game includes only standard chessmen.

9. The game of claim 1, wherein all of said additional royalty pieces in each of said additional sets are identical.

10. The game of claim 9, wherein all of said additional royalty pieces in each of said additional sets are queens.

11. A multi-level chess game for three-dimensional play, comprising:

first and second, but no more than two, substantially identical chess boards, one of said chess boards being substantially transparent;

means for spacing said two chess boards vertically away from each other;

two conventional sets of standard chessmen, each of said conventional sets including a king, a queen, two knights, two bishops, two rooks, and eight pawns, each of said conventional sets being initially positioned in standard fashion on said first chess board; and two additional sets of standard chessmen, each of said additional sets consisting of:

1. two additional royalty pieces, each additional royalty piece being chosen from the group consisting of: queen, bishop, rook and knight, at least one of said additional royalty pieces being a queen; and

2. two additional pawns, each of said additional sets being initially positioned on said second chess board.

* * * * *